United States Patent [19]

Etcheparre et al.

[11] Patent Number: 4,708,331

[45] Date of Patent: Nov. 24, 1987

[54] DEVICE FOR LAYER-STACKING WEB-LIKE MATERIALS

[75] Inventors: Jean Etcheparre; Bernard Etcheparre, both of Bordeaux, France

[73] Assignee: Societe Anonyme: Letra Systemes, Cestas Bourg, France

[21] Appl. No.: 848,086

[22] Filed: Apr. 4, 1986

[30] Foreign Application Priority Data

Apr. 4, 1985 [FR] France ..... 85 05184

[51] Int. Cl.[4] ..... B65H 29/46

[52] U.S. Cl. ..... 270/31

[58] Field of Search ..... 270/30–31; 83/925 CC

[56] References Cited

U.S. PATENT DOCUMENTS

| | | | |
|---|---|---|---|
| 2,118,556 | 3/1936 | Haberstump et al. | 270/31 |
| 2,544,951 | 3/1951 | DeLassus | 270/31 |
| 3,181,859 | 5/1965 | Sayles | 270/31 |
| 3,400,927 | 9/1968 | Martin, Sr. et al. | 270/31 |
| 3,645,524 | 2/1972 | Grimm et al. | 270/31 |
| 3,776,542 | 12/1973 | Benson et al. | 270/31 |
| 3,817,513 | 6/1974 | Frederick | 270/31 |
| 3,941,367 | 3/1976 | Stumpf | 270/31 |
| 3,951,398 | 4/1976 | Stumpf | 270/31 |
| 4,262,893 | 4/1981 | Sgroi | 270/31 |
| 4,477,065 | 10/1984 | Smith et al. | 270/31 |
| 4,519,595 | 5/1985 | Adachi | 270/31 |
| 4,575,065 | 3/1986 | Jung et al. | 270/31 |

FOREIGN PATENT DOCUMENTS

| | | | |
|---|---|---|---|
| 2507453 | 4/1976 | Fed. Rep. of Germany | 270/31 |
| 794463 | 5/1958 | United Kingdom | 270/31 |
| 1264533 | 2/1972 | United Kingdom | 270/31 |

*Primary Examiner*—E. H. Eickholt

*Attorney, Agent, or Firm*—Millen & White

[57] ABSTRACT

The invention related to a device for layer-stacking web-like materials, comprising a fixed table on which a carriage is mounted for sliding, said carriage supporting a roll of material mounted for free rotation on a support and being held by pressure against at least one endless driving elastic belt mounted on two rollers placed in parallel relationship inside a vertical plane, said rollers being driven in rotation by a position- and speed-controllable driving member, the material being unrolled and going down freely vertically in order to be laid on the laying table.

8 Claims, 30 Drawing Figures

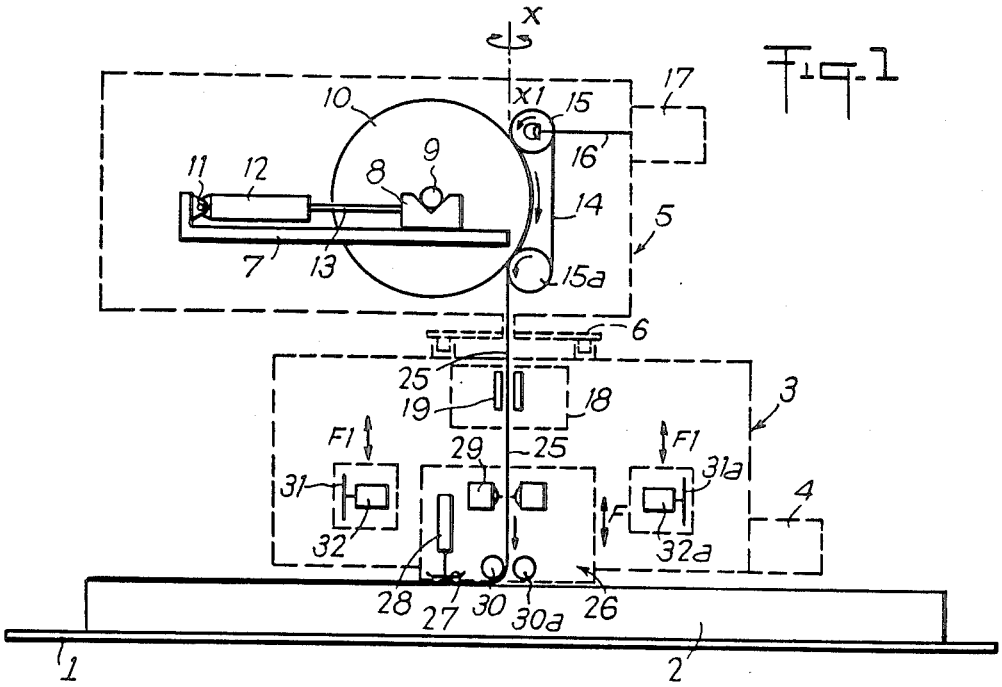
Fig. 1
Fig. 2
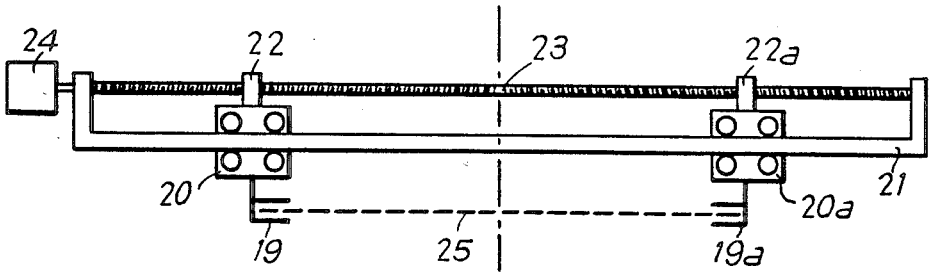

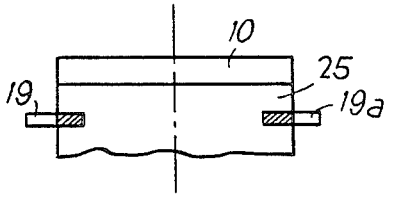
Fig. 3
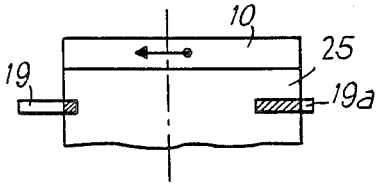
Fig. 3a
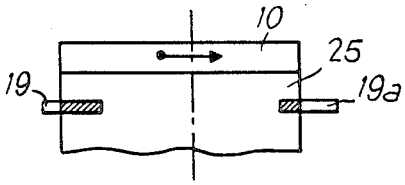
Fig. 3b
Fig. 4
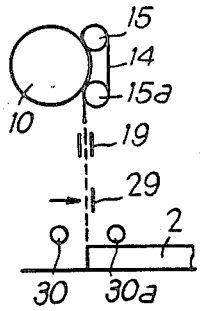
Fig. 4a
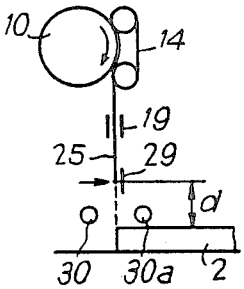
Fig. 4b
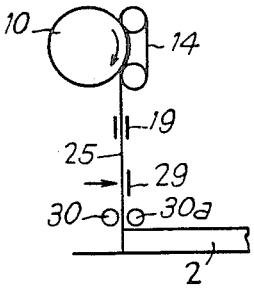
Fig. 4c
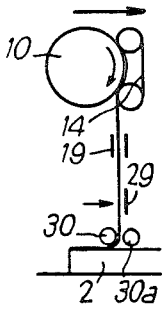
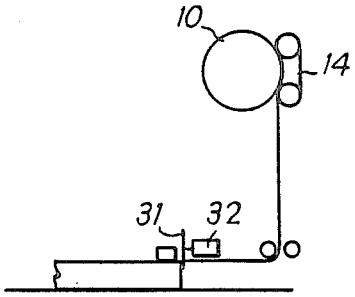
Fig. 4d

DEVICE FOR LAYER-STACKING WEB-LIKE MATERIALS

BACKGROUND OF THE INVENTION

The present invention relates to a device for layer-stacking web-like materials.

The layer-stacking operation consists in superposing a plurality of layers of web-like material of given length on a support generally constituted by a table. A laying carriage is used to this effect.

In order to fit in with the modernization of the production means in tailoring workshops, the main characteristics of such a laying carriage must be as follows:

- possibility of laying different types of material,
- possibility of creating layer-stacks of different configurations,
- no internal tension created in the material being laid;
- accurate laying on the support,
- quality of the laying (for example no creases)
- total automation,
- automatic control of width centered on the central supporting axis.

The main disadvantages presented by the conventional laying carriages are as follows:

- impossibility to treat extensible materials without using a special heavy and cumbersome mechanism;
- frequent inaccuracy of laying, particularly on the ends,
- generally partial automation, always requiring the presence of an operator close to the laying device for controlling the operations.

SUMMARY OF THE INVENTION

It is the object of the present invention to overcome the aforesaid disadvantages, by proposing an improved layer-stacking device.

The device according to the invention comprises a fixed table on which a carriage is mounted for sliding, said carriage supporting a roll of material mounted for free rotation on a support and being held by pressure against at least one endless driving elastic belt mounted on two rollers placed in parallel relationship inside a vertical plane, said rollers being driven in rotation by a position- and speed-controllable driving member, the material being unrolled and going down freely vertically in order to be laid on the laying table.

The device according to the invention provides a contact force between the material and the elastic endless belts driving the roll of material, which can be accurately adjusted and which is independent of the weight of said roll.

The loading of the roll of material may be fully automated.

The tangential driving of the roll of material permits a very accurate control over the unrolling.

Finally, with said device, the material falls under its own weight, vertically to the lower roll on which the driving belts are mounted, so that the material can be treated directly by the measuring and guiding members.

According to another characteristic of the invention, the carriage is equipped with means of controlling the selvedges of the plies of material, said means consisting of two optoelectronic cells between which passes the material and which move over a guide-rail placed in parallel to the material, the movement of the cells being such that the distance between them is always centered on a longitudinal axis of the table.

The said control means corrects two different types of faults:

- defective rolling: the material is never perfectly rolled on its supporting tube,
- differences in the width of the piece of material due to said material manufacturing process.

With the device according to the invention, the ply of material is accurately centered on a longitudinal axis of the machine, this reducing the material internal stresses to a minimum.

The device according to the invention permits to gauge with accuracy the displacements of the carriage and the simultaneous unrolling of the material; it is in particular possible to vary the accelerations and speeds in relation to the different materials and thus to achieve a perfect laying of said material.

The laying of the material is performed strainlessly right from the start of the stacking operation; it is no longer necessary to hold the material by its end with a clamp, as this is the case with the conventional laying carriages.

In general, such clamps are bulky, difficult to adjust and to keep in position.

BRIEF DESCRIPTION OF THE DRAWINGS

The invention will be more readily understood on reading the following description with reference to the accompanying drawings, in which:

FIG. 1 is an elevational view of one embodiment of the device for layer-stacking web-like materials according to the invention;

FIG. 2 is a plan view of the means for controlling the selvedges of the material;

FIGS. 3*a* to 3*b* are diagrams illustrating the control of the position of the selvedge of the material;

FIGS. 4 to 4*d* are diagrams illustrating the different layer-stacking operations conducted with the device according to the invention;

DETAILED DESCRIPTION

Figure 5:
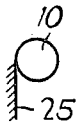
FIGS. 5 to 5*d* are diagrams illustrating a first type of layer-stacking.

Referring first to FIG. 1, this shows a supporting member such as for example a fixed table 1, over which is laid a stack 2 constituted by a plurality of superposed layers of web-like material of given length, said table 1 being supported by a main chassis, not shown in the drawings, on which a laying carriage 3 is guided in translation via rails. Said carriage 3 is driven by a motor 4 of controllable position and speed so as to control its displacements with great accuracy. Said carriage 3 which moves above the stack of cloth 2 is provided at its upper part with a turret 5 mounted for pivoting on said carriage about a vertical axis by means of a bearing 6. Said turret 5 can pivot with respect to the carriage 3 about axis $X\text{-}X_1$ centered on the point of fall of the cloth, thereby permitting the creation of all types of stacks as described hereinafter.

Said turret 5 comprises sliding rails 7 on which V-shaped supports 8 are slidably mounted, said supports receiving the spindle 9 of a roll of cloth 10, which spindle is completely free in rotation on the V-shaped supports 8.

The body 12 of a jack is fixed on sliding rails 7, via a joining plate 11, the rod 13 of which jack is integral with V-shaped supports 8, so as to move the roll of cloth horizontally in order to bring it into contact with elastic endless belts 14 driving the roll 10 in tangential rotation.

Said endless belts 14 are mounted on two rollers 15, 15*a* so as to have a regular interval between them, the said rollers being arranged in parallel together inside a vertical plane, in a position which is fixed with respect to the turret 5. At least one of said rollers 15 is connected, via a transmission 16, to a motor 17 fixed on the turret, said motor driving the rollers in rotation and the endless belts 14 in translation, which belts drive the roll of cloth 10 when the latter is in contact with said belts under the action of the jack 12. The motor 17 is controllable in position and speed.

A means 18 of controlling the selvedge of the cloth is mounted at the upper part of the carriage 3, thus ensuring that the layer of cloth is always centered on a longitudinal axis of the table 1.

To this effect, the said means is constituted (FIGS. 1 and 2) by two optoelectronic cells 19, 19*a* which are fixed on two carriages 20, 20*a* moving over a rail 21 arranged in parallel to the cloth, said carriages carrying bolts 22, 22*a* which are engaged on a bar 23 threaded left and right, said bar 23 being mounted for rotating in bearings provided on the ends of the rail and being driven by a motor 24.

The cells 19, 19*a* move in such a way that the distance between them is always centered on a longitudinal axis of the machine.

Said cells 19, 19*a* are placed in such a way that the cloth 24 passes between them just at its exit from the unrolling system.

The cells act via an electronic computer on a motor (not shown) permitting the transverse displacement of the turret 5 via bearing means 6. Thus, once the cells register an alteration in the width of the layer, the cloth is immediately brought back in a longitudinal axis of the machine.

A cloth laying means 26 is mounted at the base of the carriage 3, said means being vertically movable in the direction of double arrow F, and being actuated by a driving member controllable in position. The object of said means is, during the vertical descent of the cloth, to lay said cloth on the stacking table 1.

Said means 26 comprises a sensor 27 actuated by a jack 28 permitting the positioning of the cloth laying means 26 at a constant height with respect to the upper layer of the stack 2.

Said laying means are provided at their upper part with an optoelectronic cell 29 the object of which is to stop the end of the cloth 25, very precisely at a given height which is dependent on the position of the sensor 27.

At the base of said laying means 26 are arranged elements 30, 30*a* for deviating the path of the cloth 25 and for eliminating any creases. Said elements can be moved apart to leave a free passage when the cloth is going down between them. Two such elements 30, 30*a* are used in order to lay the cloth in both directions.

Said elements may be constituted by banana rolls, or rolls with jets of compressed air, etc . . . .

On either side of said laying means are mounted two cutting members 31, 31*a* constituted in particular by circular cutters driven in rotation by motors 32, 32*a* each cutter and its motor being mounted on a guide rail (not shown) placed transversely and parallely to the stack 2.

Each cutter is shifted with respect to the point of fall of the cloth. Therefore the carriage 3 must be moved forward beyond the end of the stack of a value equal to said shifting in order to place the cutter above the end of the stack 2.

The guide rail supporting the cutter 31, 31*a* is adapted to move vertically in the direction of arrow F1, so that by lowering the cutting assembly, said latter comes to rest on the stack 2 and the cutter cuts the ply flush with the end of the stack.

The layer-stacking device according to the invention works as follows:

As illustrated in FIG. 4, the roll of cloth, with its central spindle 9 (FIG. 1) is placed on the V-shaped supports 8, the jack 12 being in retracted position.

The pressure inside jack 12 is then reversed so that the supports 8 slide in the direction of endless belts 14 in order to bring the roll of cloth 10 in contact therewith. The pressure of the compressed air inside the jack is adjusted such that there is no crushing of the cloth or not too much stretching of the endless belts 14.

At that moment, the cloth being in contact with the endless belts 14 and the rollers 15, 15*a*, it suffices to energize the motor 17 in order to roll out the cloth. Because of the tangential drive of the cloth, it is possible to control, with accuracy, the rolled out length of cloth.

The carriage 3 being immobilized in a spot such that the point of fall of the cloth is situated exactly above the start of the stack 2 (FIG. 4*a*) the cloth is rolled out slowly and passes through the selvedge-controlling cells 19, 19*a* until it reaches optoelectronic cell 29.

Elements 30, 30*a* are in set-apart position. The distance d between cell 29 and the upper surface of the stack, which is indicated by sensor 27, is known exactly.

Then, the cloth is rolled out of a value corresponding to said distance d. The cloth reaches just in contact with the upper angle of the stack 2 (FIG. 4*b*).

Guiding elements 30, 30*a* are then brought closer together.

From that position, the layer-stacking operation can be performed. The carriage 3 moves and, simultaneously, and in perfect synchronism, the cloth 25 is rolled out in order to be laid on the stack strainlessly (FIG. 4*c*).

During the displacement of the carriage for the layer-stacking operation, the means controlling the selvedge ensures the centering of the cloth on the table.

To this effect and at the beginning of the operation, the optoelectronic cells 19, 19*a* are at a maximum distance apart (FIG. 2), then the cloth is lowered between said cells.

The cells 19, 19*a* are then brought slowly closer together and immediately one of them contacts with the cloth, the roll 10 of cloth is moved in the opposite direction (FIGS. 3*a*, 3*b*) to return the cloth to the centering position illustrated in FIG. 3.

Once the two cells 19, 19*a* are covered (FIG. 3), they are immobilized, the computer compares the covered surfaces and acts on the cloth so as to balance them.

This enables the measurement in real time of the width of the layer and this value may be communicated to the central computer and used as a parameter of control of the operation of the machine.

When a new ply of cloth has been laid on the stack 2, one of the cutting assemblies is lowered and brought to rest against said stack (FIG. 4*d*). The cutter 31 then cuts the ply flush with the end of the stack.

When the cutting operation is completed, the cloth is rolled up again as far as the cell 29, the carriage 3 is moved on top of the other end of the stack 2 and another ply of cloth is laid.

Figure 5A:
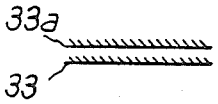
Figure 5B:
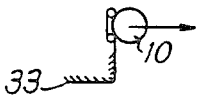
Figure 5C:
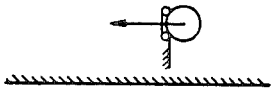
Figure 5D:
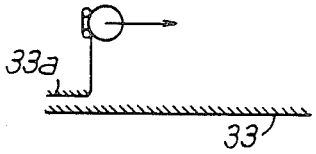

FIGS. 5 to 5*d* show a first type of layer-stacking in which the pattern of the cloth is always oriented towards the upper part of the stack, plies 33 and 33*a* being arranged as illustrated in FIG. 5*a* and the cloth being rolled out as illustrated in FIG. 5.

During a first forward run, the carriage 3 lays a first play 33 on the stack (FIG. 5*b*), then returns without cloth after the cutting of ply 33 (FIG. 5*c*). Said carriage then makes a second forward run, during which it lays a second ply 33*a* over ply 33 (FIG. 5*d*), and returns without cloth after the cutting at the end of the stack, (FIG. 5*c*), and so on.

Figure 6:
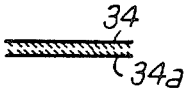
FIGS. 6 to 6*b* are diagrams illustrating a second type of layer-stacking.
Figure 6A:
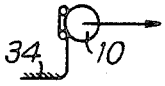
Figure 6B:
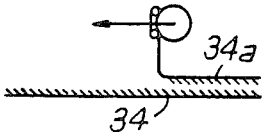

FIGS. 6 to 6*b* show an accordeon-folded stack in which the patterns of the fabric are arranged in mutually facing relationship (FIG. 6).

In this case, the carriage 3 makes a first forward run during which it lays a ply 34 on the stack (FIG. 6*a*). After cutting at the end of the stack, the carriage returns while laying a second ply 34*a* over ply 34 (FIG. 6*b*). The operation is then repeated after the cutting of each ply at the end of the stack.

Figure 7:
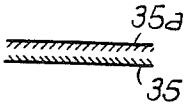
FIGS. 7 to 7*f* are diagrams illustrating a third type of layer-stacking.
Figure 7A:
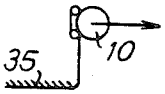
Figure 7B:
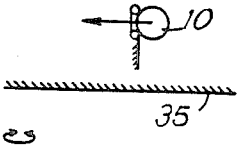
Figure 7C:
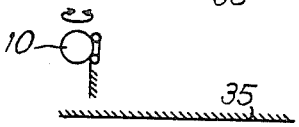
Figure 7D:
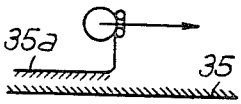
Figure 7E:
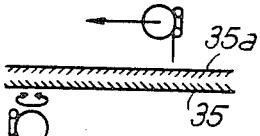
Figure 7F:
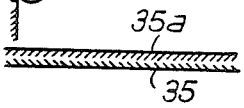

FIGS. 7 to 7*f* show a third type of layer-stacking in which the carriage makes a first forward run (FIG. 7*a*) while laying a ply 35 on the stack. After cutting at the end of the ply of cloth, the carriage 3 returns without cloth to its starting point (FIG. 7*b*) after what the turret 5 is pivoted of 180° (FIG. 7*c*).

The carriage then makes a second forward run (FIG. 7*d*) while laying a ply of fabric 36 over the ply 35 and, after cutting at the end thereof, said carriage makes a second return empty (FIG. 7*e*).

Then the turret 5 is once again pivoted of 180° (FIG. 7*f*).

Figure 8:
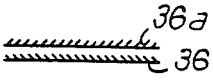
FIGS. 8 to 8*d* are diagrams illustrating a fourth type of layer-stacking.
Figure 8A:
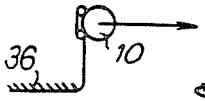
Figure 8B:
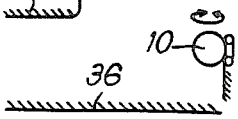
Figure 8C:
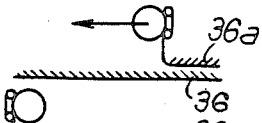
Figure 8D:
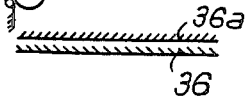

FIGS. 8 to 8*d* show a first type of layer stacking in which a first ply 36 is laid on the stack during a first forward run (FIG. 8*a*).

An end cutting is then carried out at a rotation of the turret 5 (FIG. 8*b*). On the return run of the carriage 3 (FIG. 8*c*) a ply 36*a* is formed over ply 36 after what the turret 5 is pivoted of 180° (FIG. 8*d*).

The invention is no way limited to the description given hereinabove and on the contrary covers any modifications brought thereto without departing from its scope.

What is claimed is:

1. A device for layer-stacking web-like materials in plys with aligned selvedges, comprising a fixed laying table (1) on which a carriage (3) is mounted for sliding motion with respect thereto in a longitudinal direction, said carriage supporting a roll (10) of material for free rotation about an axis (9) on the carriage, the axis being on a support (8) and being held by pressure against at least one endless driving elastic belt (14) mounted on two vertically aligned rollers (15, 15*a*) extending inside a vertical plane tangent to the roll of material, said rollers being driven in rotation by a position and speed-controllable driving motor (17), an unobstructed vertical path extending through the carriage (3) to the fixed laying table, wherein the material is unrolled and goes down freely in a vertical in order to be laid on the laying table (1) as the carriage moves in the longitudinal direction.

2. A device as claimed in claim 1, wherein the roll (10) of material is mounted in a turret (5), said turret (5) being mounted by a bearing means (6) upon the carriage (3) and being both pivotable about a vertical axis (X-X1) and transversely movable in a lateral direction.

3. A device a claimed in claim 1, wherein said roll (10) of material is mounted on V-shaped supports (8), said supports (8) being mounted on sliding rails (7) and actuated by a jack (12) adapted to keep the roll (1) pressed against an endless driving belt (14) fitted on two rollers (15, 15*a*).

4. A device as claimed in claim 1, wherein said carriage is equipped with means (18) for controlling the selvedge of the ply of material, said means including two optoelectronic cells (19, 19*a*) between which cells passes the material and motor means for moving the optoelectronic cells in the lateral direction on a guide-rail (21) placed in parallel to the material.

5. A device as claimed in claim 4, wherein the two optoelectronic cells (19, 19*a*) are integral with carriages (20, 20*a*) moving over a rail (21) and are provided with bolts (22, 22*a*) which are engaged on a bar (23), threaded left and right and driven in rotation by a motor (24).

6. A device as claimed in claim 4, wherein the two optoelectronic cells (19, 19*a*) actuate, a motor ensuring the transverse displacement of the turret (5) so that, when a difference in the width of a ply is detected by said cells, the material is brought back on a longitudinal axis of the table.

7. A device as claimed in claim 1, wherein the carriage (3) comprises a material-lying means (26) which is movable vertically in relation to the height of the stack and which is actuated by a driving member controllable in position, said laying means (26) comprising a sensor (27) actuated by a jack (28), for positioning the laying means at a constant height with respect to the upper ply of the stack (2), and optoelectronic cell (29) sensing the presence of the material and connected to the drive motor (17) to selectively stop the end of the material at a given height.

8. A device as claimed in claim 7, wherein said carriage (3) is provided on each side of the material laying means (26), with cutting members (31, 31*a*) for cutting the ply ends, the cutting members (31, 31*a*) by mounted for movement transversely to the stack (2) and said cutting members (31, 31*a*) being driven by driving members (32, 32*a*).

* * * * *